US005782627A

United States Patent [19]

Döbbeling et al.

[11] Patent Number: 5,782,627

[45] Date of Patent: Jul. 21, 1998

[54] PREMIX BURNER AND METHOD OF OPERATING THE BURNER

[75] Inventors: Klaus Döbbeling, Windisch; Hans Peter Knöpfel, Besenbüren; Timothy Griffin, Ennetbaden, all of Switzerland

[73] Assignee: ABB Research Ltd., Zurich, Switzerland

[21] Appl. No.: 865,102

[22] Filed: May 29, 1997

[51] Int. Cl.[6] ..... F23M 3/00

[52] U.S. Cl. ..... 431/9; 431/284; 431/285

[58] Field of Search ..... 431/284, 285, 431/174, 9

[56] References Cited

U.S. PATENT DOCUMENTS 4,781,030 11/1988 Hellat et al. .
5,307,634 5/1994 Hu .
5,340,306 8/1994 Keller et al. .
5,573,395 11/1996 Althaus et al. ..... 431/284
5,584,684 12/1996 Dobbeling et al. ..... 431/285

FOREIGN PATENT DOCUMENTS

0321809B1 6/1989 European Pat. Off. .
0610722A1 8/1994 European Pat. Off. .
3446788A1 7/1986 Germany .
682952A5 12/1993 Switzerland .

*Primary Examiner*—Carroll B. Dority
*Attorney, Agent, or Firm*—Burns, Doane, Swecker & Mathis, L.L.P.

[57] ABSTRACT

In a burner of the double-cone design, bores (27) are arranged in the burner sickle (26), via which bores (27) the gaseous fuel (16), to the extent of about 3 to 8% of the total mass fuel flow, is mixed into the outer recirculation zone (28) of the burner. This leads to additional outer stabilization of the flame and to an extended operating range of the burner.

5 Claims, 3 Drawing Sheets

PREMIX BURNER AND METHOD OF OPERATING THE BURNER

BACKGROUND OF THE INVENTION

1. Field of the Invention

The invention relates to the field of combustion technology. It relates to a premix burner of the double-cone design and a method of operating the burner.

2. Discussion of Background

EP 0 321 809 B1 discloses the basic construction of a burner of the double-cone design, to which the invention relates. This burner essentially comprises hollow sectional cone bodies complementing one another to form one body and having tangential airinlet slots and feeds for gaseous and liquid fuels, in which burner the center axes of the hollow sectional cone bodies have a conicity widening in the direction of flow and run offset from one another in the longitudinal direction. A fuel nozzle is placed at the burner head in the conical interior space formed by the sectional cone bodies. Via gas injectors arranged along the inlet slots, the gaseous fuel is fed to the combustion-air flow prior to its inflow into the interior space of the burner. The forming of the fuel/air mixture therefore takes place directly at the end of the tangential air-inlet slots. The inlet plane of the combustion air and the gas-inlet plane (perforation plane) therefore coincide in this known prior art.

The increase in swirl along the cone axis, in combination with the sudden widening in cross section at the burner outlet, leads to the formation of a backflow zone (inner recirculation zone) downstream of the burner outlet on the burner axis, which backflow zone stabilizes the flame. The ignition of the flame is not initiated until the stagnation point of this inner backflow zone.

In certain operating states, e.g. close to the extinction limit or during lean operation of the premix stage, i.e. during the transition to head-stage operation, in which pilot gas is additionally injected close to the axis of the burner (internal piloting) for the purpose of making the fuel/air mixture richer, the burner tends to vibrate. This in turn results in the operable range of the burner, that is, its stability range, being restricted and in the burner being extinguished prematurely.

The cause of the vibrations and of the extinction under comparatively fuel-rich conditions is the inadequate flame stabilization of the burner. The burner is certainly stabilized by the internal recirculation zone, which is supplied with additional fuel during head-stage operation. However, the outer shearing layer of the fuel/air mixture discharging from the burner, which shearing layer provides a substantially larger contact area between fresh gas and exhaust gas compared with the inner recirculation zone, has hitherto not been utilized for stabilization.

SUMMARY OF THE INVENTION

Accordingly, one object of the invention is to modify the known burner of the double-cone design by simple constructional means and operate it in such a way that additional stabilization of the flame is effected without a significant increase in the pollutant emission values.

According to the invention, this is achieved in that in a burner according to the preamble of claim 1 at least one bore is arranged in the burner sickle, which bore serves to feed gaseous fuel into the outer recirculation zone. According to the invention, this is achieved in a method of operating the burner in that about 3 to 8% of all the gaseous fuel is mixed into the outer recirculation zone.

The advantages of the invention consist, inter alia, in the fact that the flame stability is improved, i.e. smaller pressure pulsations occur in the flame. In addition, the burner according to the invention is distinguished by a lower lean extinction limit compared with the known prior art, so that it has an extended operating range. As a further advantage, a reduced burn-out length is obtained due to the intensifying of the outer reaction front.

It is especially expedient if the bores are oriented parallel to the burner axis, since this design is very simple to realize.

Furthermore, it is advantageous if the bores are arranged so as to slope outwards at an angle of about 45° to the burner axis. Particularly intensive mixing of the fuel with the exhaust gas of the outer recirculation zone is then possible. The same thing is effected in an advantageous manner if the additional bores are arranged in the burner sickle in such a way that they bring about an injection of the fuel in the opposite swirl direction to the swirl direction of the exhaust gas in the recirculation zone.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a burner of the double-cone design used, for example, for operating a gas turbine, wherein.

DESCRIPTION OF THE PREFERRED EMBODIMENTS

Figure 1:
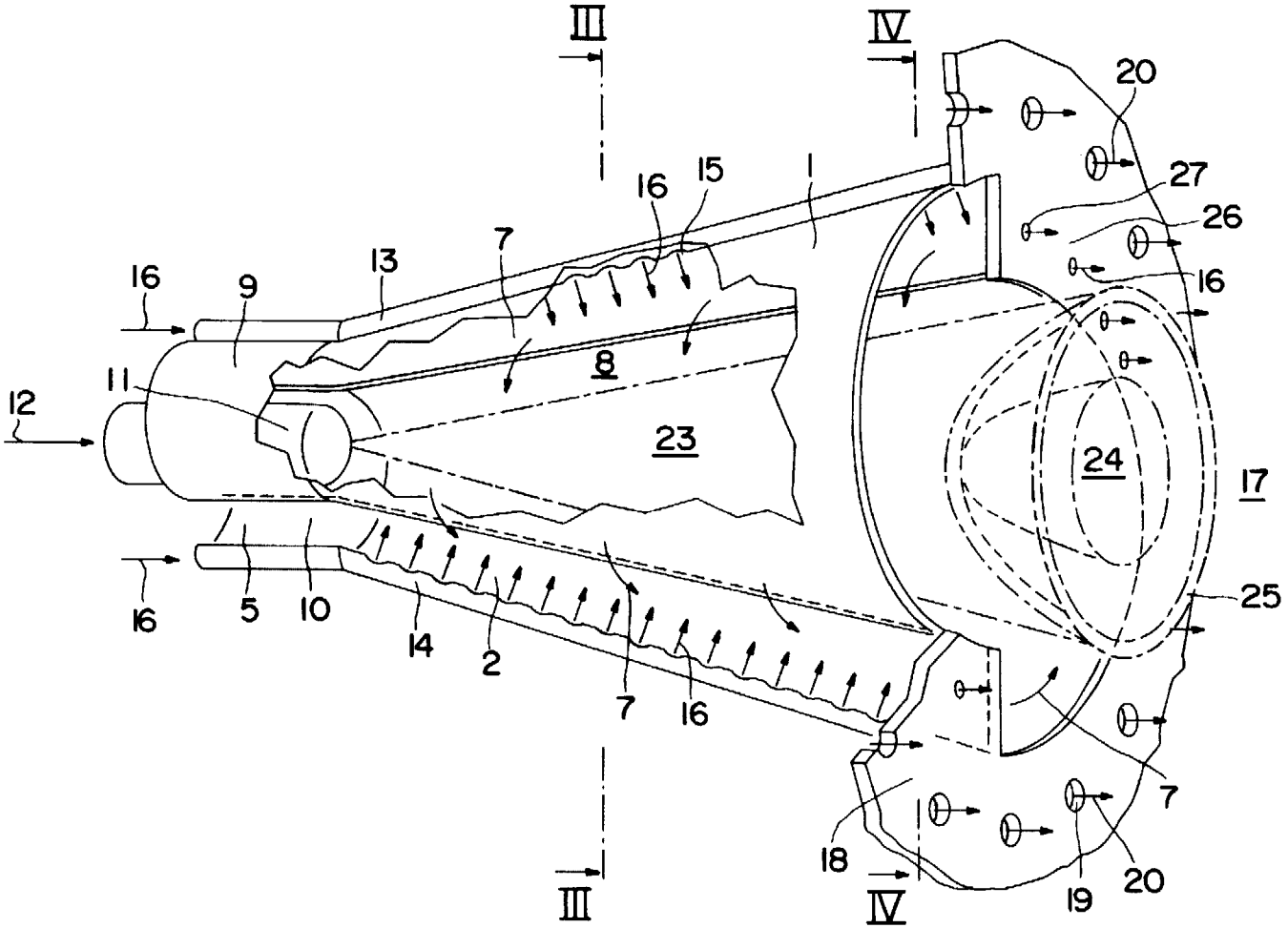
FIG. 1 shows a perspective representation of the double-cone burner.
Figure 2:
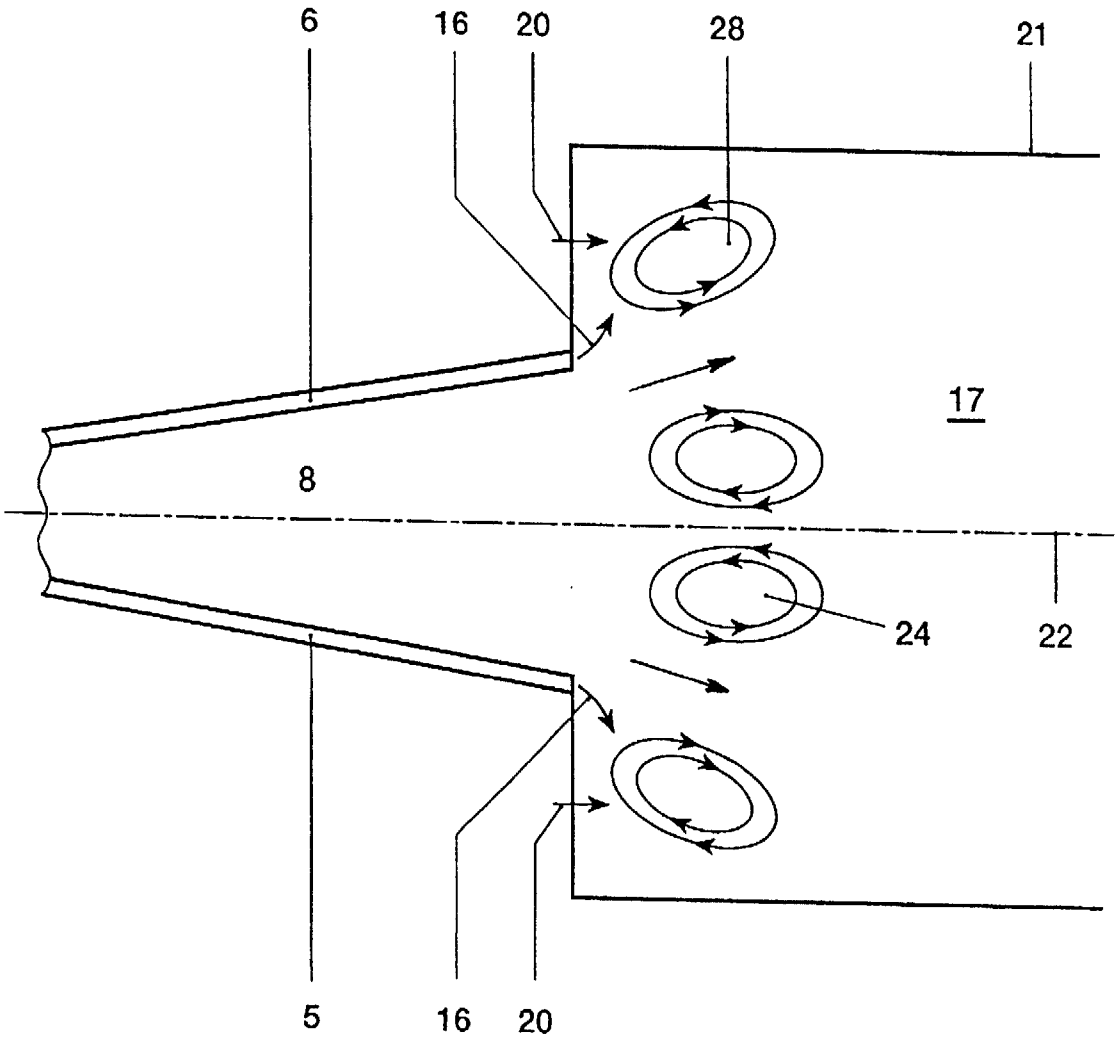
FIG. 2 shows a longitudinal section of the burner with the combustion chamber in schematic representation.
Figure 3:
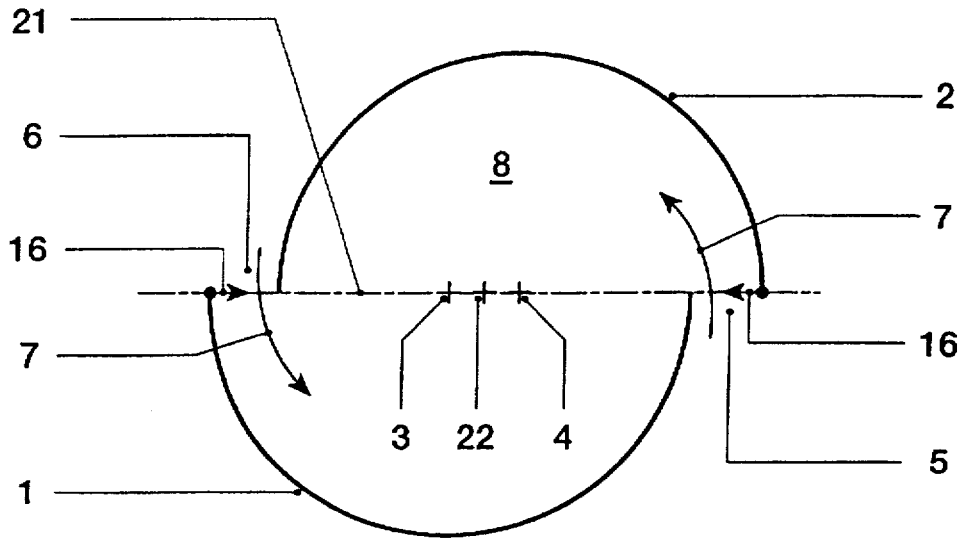
FIG. 3 shows a cross section of the burner according to FIG. 1 along plane III—III.
Figure 4:
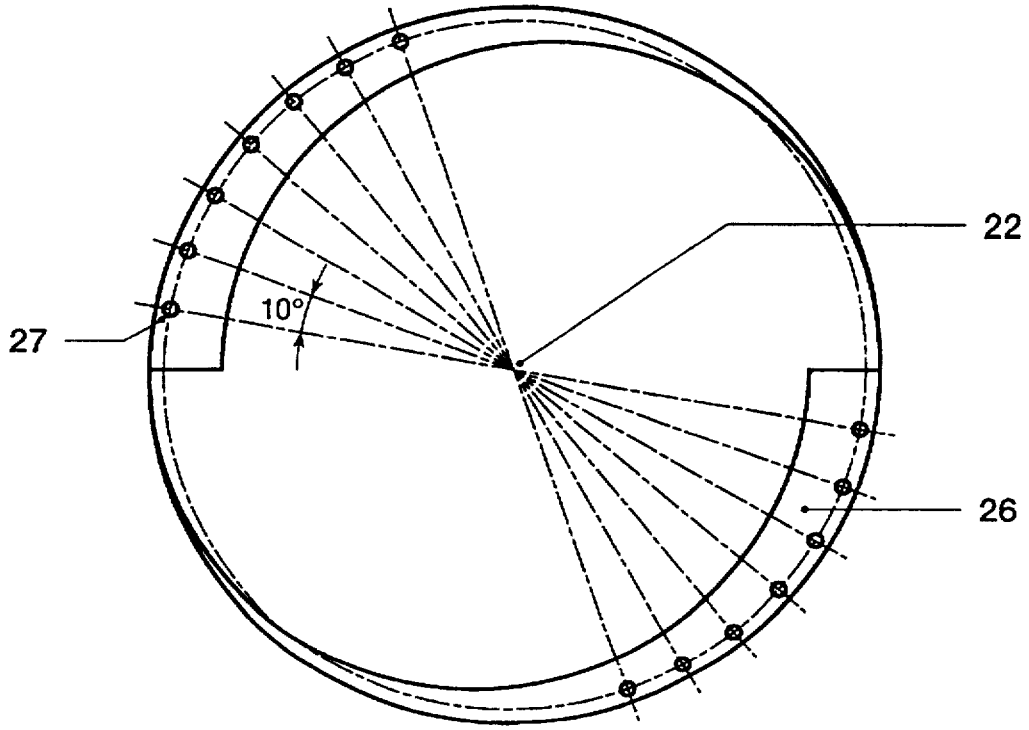
FIG. 4 shows a cross section of the burner according to FIG. 1 along plane IV—IV.

Referring now to the drawings, wherein like reference numerals designate identical or corresponding parts throughout the several views, only the elements essential for understanding the invention are shown, and the directions of flow of the various media are designated by arrows. FIG. 1 shows the burner according to the invention in perspective representation. For the state of better comprehension, it is advantageous if the sections in FIGS. 2 to 4 are used at the same time as FIG. 1.

The burner comprises two hollow sectional cone bodies 1, 2 which lie one on top of the other in a mutually offset manner. The mutual offset of the respective center axes 3, 4 of the sectional cone bodies 1, 2 provides on both sides, in mirror-image arrangement, one tangential air-inlet slot 5, 6 each, through which air-inlet slots 5, 6 the combustion air 7 passes into the interior space 8 of the burner. The two sectional cone bodies 1, 2 each have a cylindrical initial part 9, 10 which likewise run offset from one another, so that the tangential air-inlet slots 5, 6 are also present in this region. A nozzle 11 for atomizing the liquid fuel 12 is accommodated in this cylindrical initial part 9, 10. The burner may also be constructed without the cylindrical initial parts 9, 10, so that it is of purely conical design. The fuel nozzle 11 is then directly accommodated in the cone point. The two sectional cone bodies 1, 2 each have a fuel line 13, 14, which fuel lines are provided with openings 15 which represent fuel injectors. Gaseous fuel 16 is added by the fuel injectors 15 to the combustion air 7 flowing through the tangential air-inlet slots 5, 6.

On the combustion-chamber side 17, the burner has a front plate 18 serving as anchorage for the sectional cone bodies 1, 2 and having a number of bores 19 through which diluent or cooling air 20 can be fed to the front part of the combustion space 17 or its wall.

If liquid fuel 12 is used to operate the burner, this liquid fuel 12 flows through the nozzle 11 and is injected at an acute angle into the interior space 17 of the burner, in the course of which a homogeneous fuel spray is produced. The conical liquid fuel profile 23 is enclosed by a rotating combustion-air flow 7 flowing in tangentially. The concentration of the liquid fuel 12 is continuously reduced in the axial direction by the intermixed combustion air 7. The optimum fuel concentration over the cross section is achieved only in the region of the vortex breakdown, i.e. in the region of the inner recirculation zone 24. The ignition is effected at the tip of the inner recirculation zone 24. The latter is supplied with additional fuel in so-called head-stage operation (not shown). Only at this point does a stable flame front 25 develop. The flame stabilization results from an increase in the swirl coefficient in the direction of flow along the cone axis. Flashback of the flame into the interior of the burner does not occur under normal operating conditions.

If gaseous fuel 16 is burned, the formation of the mixture with the combustion air 7 takes place in the air-inlet slots 5, 6, that is, before entry to the interior space 8 of the burner.

According to the invention, a number of bores 27 are arranged in the region of the burner sickle 26, which bores 27 serve to feed and mix additional gaseous fuel 16 into the outer recirculation zone 28. In the extreme case, the additional gaseous fuel 16 may also be introduced into the outer recirculation zone 28 only via a single bore 27 arranged in the burner sickle 26.

As is apparent from FIG. 2, this outer recirculation zone 28 is located in the outer region of the combustion space 17 close to the wall of the combustion chamber 21.

The bores 27 may be arranged in the burner sickle 26 in various ways, for example parallel to the burner axis 22. In other exemplary embodiments, they may also be arranged so as to slope outwards at an angle of about 45° to the burner axis 22, so that the additional gaseous fuel 16 is injected in the direction of the combustion-chamber wall. It is especially advantageous if the bores 27 are arranged in such a way that the additional gaseous fuel 16 is introduced in the opposite swirl direction to the recirculation flow, since especially intensive mixing of the additional fuel with the recirculating exhaust gas is then effected and the flame stabilization due to this is especially high.

According to the invention, the burner is to be operated in such a way that only about 3 to 8% of all the gaseous fuel passes through the openings 27 into the outer recirculation zone 28. Since the cooling air 20 is already admixed at this point and the recirculating exhaust gases have already delivered a portion of their sensible heat to the front plate 18, this additional fuel addition does not bring about any significant increase in the NOx emissions. This is the case in particular when the injections are sufficiently small in order to avoid stabilization at the inlet jets. After the intermixing of the fuel, self-ignition is effected after a certain ignition-delay time, specifically just upstream of or directly at the outer shearing layer of the discharging fuel/air mixture.

External additional stabilization (by mini pilots) is realized by the invention, which additional stabilization leads, inter alia, to an extended operating range of the burner and to increased flame stability.

Measurements with respect to a perfectly premixed test burner have shown that a displacement of the lean extinction limit by about 100° K. toward smaller temperatures with a very small increase in the pollutant emissions (additionally about 1.5 vppmd 15% $O_2$, i.e. concentration of the NOx in the dry exhaust gas) is possible.

An actual embodiment of the invention is shown in cross section in FIG. 4. The cross section shows the region of the burner discharge sickle 26. In the sickle 26, bores 27 having a diameter of 0.8 mm are arranged at an angular pitch of about 10° at 14 positions on the periphery. The number and size of the bores 27 has been selected in such a way that about 3% of the total mass fuel flow discharges there and is mixed into the outer recirculation zone 28 (not shown in FIG. 4).

The invention is of course not restricted to the exemplary embodiment just described. The solution according to the invention may likewise also be used for burners which comprise more than two sectional cone bodies, e.g. for so-called four-slot burners. In addition, the bores 27 may vary both in their number and in their position in the burner sickle 26. Care merely needs to be taken to ensure that the additional mass fuel flow which is mixed into the outer recirculation zone does not come to more than about 8% of all the fuel.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. Burner for burning liquid (12) and gaseous fuels (16), comprising at least two hollow sectional cone bodies (1, 2) complementing one another to form one body, having tangential air-inlet slots (5, 6) and feeds (13, 14) for gaseous (16) and liquid fuels (12), in which burner the center axes (3, 4) of the hollow sectional cone bodies (1, 2) have a conicity widening in the direction of flow and run offset from one another in the longitudinal direction, a fuel nozzle (11) for the liquid fuel (12) being placed at the burner head in the conical interior space (8) formed by the sectional cone bodies (1, 2), and the feeds (13, 14) for the gaseous fuel (16) being provided with fuel injectors (15), and the air-inlet slots (5, 6) being closed off on a combustion-chamber side by a burner sickle (26), wherein at least one bore (27) is arranged in the burner sickle (26), which bore (27) is connected to a source of gaseous fuel (16).

2. The burner as claimed in claim 1, wherein the at least one bore (27) is arranged parallel to the burner axis (22).

3. The burner as claimed in claim 1, wherein the at least one bore (27) is arranged so as to slope outwards at an angle to the burner axis (22), preferably at an angle of 45°.

4. A method of operating a burner as claimed in claim 1, a conical liquid fuel column (23) being formed in the interior space (8) of the burner, which liquid fuel column (23) spreads in the direction of flow, does not wet the walls of the interior space (8), is enclosed by a rotating combustion-air flow (7) flowing tangentially into the burner and gaseous fuel (16) being fed to the combustion-air flow (7) before it flows into the interior space (8) of the burner, the ignition of the mixture takes place only at the outlet of the burner, and the flame is stabilized in the region of an outlet of the burner orifice by an inner recirculation zone (24), wherein 3 to 8% of the total mass fuel flow is mixed into an outer recirculation zone (28).

5. The method as claimed in claim 4, wherein the fuel (16) mixed into the outer recirculation zone (28) is injected in the opposite direction to the swirl direction of the recirculation flow.

* * * * *